US005448275A

United States Patent [19]

Fong

[11] Patent Number: 5,448,275

[45] Date of Patent: Sep. 5, 1995

[54] THERMAL INK JET PEN HAVING FOAM CONTROLLED BACKPRESSURE REGULATION AND METHOD OF MANUFACTURE AND OPERATION

[75] Inventor: Jon J. Fong, Coral Gables, Fla.

[73] Assignee: Hewlett-Packard Company, Palo Alto, Calif.

[21] Appl. No.: 994,216

[22] Filed: Dec. 18, 1992

[51] Int. Cl.[6] ..... B41J 2/175

[52] U.S. Cl. ..... 347/87; 222/92

[58] Field of Search ..... 346/1.1, 140 R; 29/890.1; 347/86, 87; 222/92, 95

[56] References Cited

U.S. PATENT DOCUMENTS 4,771,295 9/1988 Baker et al. ..... 347/87
4,931,811 6/1990 Cowger et al. ..... 346/140 R
5,280,300 1/1994 Fong et al. ..... 346/1.1

FOREIGN PATENT DOCUMENTS 0424133 4/1991 European Pat. Off. ..... B41J 2/175
0437363 7/1991 European Pat. Off. ..... B41J 2/175
0519664 12/1992 European Pat. Off. ..... B41J 2/175

*Primary Examiner*—Benjamin R. Fuller
*Assistant Examiner*—Alrick Bobb

[57] ABSTRACT

A thermal ink jet pen including a main ink storage compartment wherein a block of foam is completely sealed off from the surrounding ambient. The pen further includes an ink delivery section which is fluidically coupled at one end to the ink storage compartment and has a thin film printhead mounted on an outer surface thereof. The above main ink storage compartment includes a pair of flexible major side walls which begin to collapse as ink and air are drawn out of the pen during an ink jet printing operation. As this happens, and the collapsible side walls are forced into the opposite surfaces of the compressed foam block, and the inherent spring force of the foam block produces an equal and opposite force in equilibrium with these side walls within the ink storage compartment. This equilibrium condition operates to stabilize the negative backpressure within the ink storage compartment at a relatively constant value and prevents the pen from drooling ink.

2 Claims, 2 Drawing Sheets

THERMAL INK JET PEN HAVING FOAM CONTROLLED BACKPRESSURE REGULATION AND METHOD OF MANUFACTURE AND OPERATION

TECHNICAL FIELD

This invention relates generally to thermal ink jet pens for use in high speed computer driven ink jet printers, and more particularly to such pens having an improved foam storage and backpressure regulation capability. More importantly, these pens may be reliably manufactured at a very low cost.

BACKGROUND ART AND RELATED APPLICATION

In the past, various types of disposable and reusable thermal ink jet pens have been developed for use in thermal ink jet printers. Examples of such disposable pens may be found in U.S. Pat. No. 4,771,295, issued to Jeffrey P. Baker et al. in U.S. Pat. No. 4,931,811, issued to Bruce Cowger et al., in U.S. Pat. No. 4,791,438 issued to Gary E. Hanson et al., and in U.S. Pat. No. 4,831,389 issued to C. S. Chan. All of these patents are assigned to the present assignee and are incorporated herein by reference.

More recently, there has been developed a refillable ink cartridge which has certain ink-independent advantages over the earlier disposable thermal ink jet pens of the types described in the above Hewlett Packard-assigned patents. This refillable thermal ink jet pen and these ink-independent advantages over earlier art are disclosed and claimed in co-pending applications entitled "Ink Pressure Regulator For A Thermal Ink-Jet Printer" Ser. No. 07/928,811, filed Aug. 12, 1992, by Tofigh Khodapanah et al, and "Collapsible Ink Reservoir Structure and Printer Ink Cartridge", Ser. No. 07/929,615, filed Aug. 12, 1992, by George T. Kaplinsky et al. These co-pending applications are also assigned to the present assignee and are also incorporated herein by reference.

The above Kaplinsky pen utilizes an ink pressure regulator within a flexible ink bag reservoir for a replaceable or refillable ink cartridge. This ink pressure regulator comprises a bow spring configured to have substantially linear force/deflection characteristics and a pair of adjacent plates which collapse to a substantially flat shape to minimize the amount of ink remaining within the ink bag reservoir after thermal ink jet printing has substantially depleted the ink from the ink cartridge.

All of the above identified Hewlett Packard inventions represent most significant advances in the art and technology of thermal ink jet printing.

DISCLOSURE OF INVENTION

The general purpose and principal object of the present invention is to provide still further new and useful improvements in the field of thermal ink jet pen body construction and particularly to improvements which operate to integrate the piston plates and spring of the above described Kaplinsky pen into a single material. In this manner, the cost and complexity of the above Kaplinsky pen can be substantially reduced, while simultaneously making the present thermal ink jet pen easy to assemble.

The above purpose and object are accomplished by, among other things, providing an outer unitary frame or housing member having a top wall, two rigid side walls, and a bottom wall, all defining in part the outer boundaries an ink storage compartment of an ink jet pen. A block of a chosen foam material is positioned inside the ink storage compartment, and then two flexible side walls are secured by heat staking to the unitary frame member on each side of the block of foam to completely seal off the ink storage compartment from the surrounding environment. The ink jet pen further includes an ink delivery and printhead support section which is integrally joined and fluidically coupled to the ink storage compartment at its upper end and has a thin film thermal ink jet printhead affixed to its lower end. The above two flexible side walls are preferably made of a thin plastic film material which will start to collapse as ink is drawn from the ink storage compartment and through the ink delivery section and printhead during an ink jet printing operation.

Since the ink storage compartment is completely sealed from the surrounding ambient, this collapsing action, in turn, generates an increasing negative backpressure (sub-atmospheric pressure) within the ink storage compartment which is necessary to prevent the pen from drooling ink. However, this negative backpressure will stabilize when the thin plastic film walls depress the block of foam within the ink storage compartment and collapse the block of foam to its point of maximum compression. At this point, an equilibrium condition is reached between the force of the collapsing thin film walls produced by ink and air pulled out of the pen and an equal and opposite repelling inherent spring force of the foam block. Thus, this single block of foam operationally takes the place of the metal spring and piston plates in the above identified Kaplinsky pen, thereby facilitating the ease of pen body manufacture while simultaneously reducing its cost and complexity.

Accordingly, another object of this invention is to provide a new and improved thermal ink jet pen of the type described which has a high price/performance figure of merit.

Another object of this invention is to provide a new and improved thermal ink jet pen of the type described which may be easily filled and primed.

Another object of this invention is to provide a new and improved thermal ink jet pen of the type described which is reliable in operation and durable in construction.

Another object of this invention is to provide a new and improved thermal ink jet pen of the type described which has a design and construction readily compatible for use with existing pen carriages of existing thermal ink jet printers.

A novel feature of this invention is the provision of a new and improved method of operating a thermal ink jet pen of the type having a thin film ink jet printhead fluidically coupled to ink stored within a foam material in an ink storage compartment. This method is characterized by the steps of sealing off the ink storage compartment from the surrounding ambient and then collapsing side walls of the ink storage compartment to create a negative backpressure therein and reaching an equilibrium condition in the compartment where the collapsing force of the side walls is equal and opposite to the inherent repelling spring force of the foam material.

Another feature of this invention is the provision of a new and improved method of manufacturing an ink jet pen which includes the steps of enclosing a depressible foam storage block into an ink storage compartment of the pen and then heat staking flexible and collapsible side walls to the ink storage compartment to completely seal off the foam block from the surrounding ambient.

The above brief summary of the invention, together with its attendant objects, novel features and various advantages will become more readily apparent from the following description of the accompanying drawing.

DETAILED DESCRIPTION OF THE PREFERRED EMBODIMENT

Figure 1:
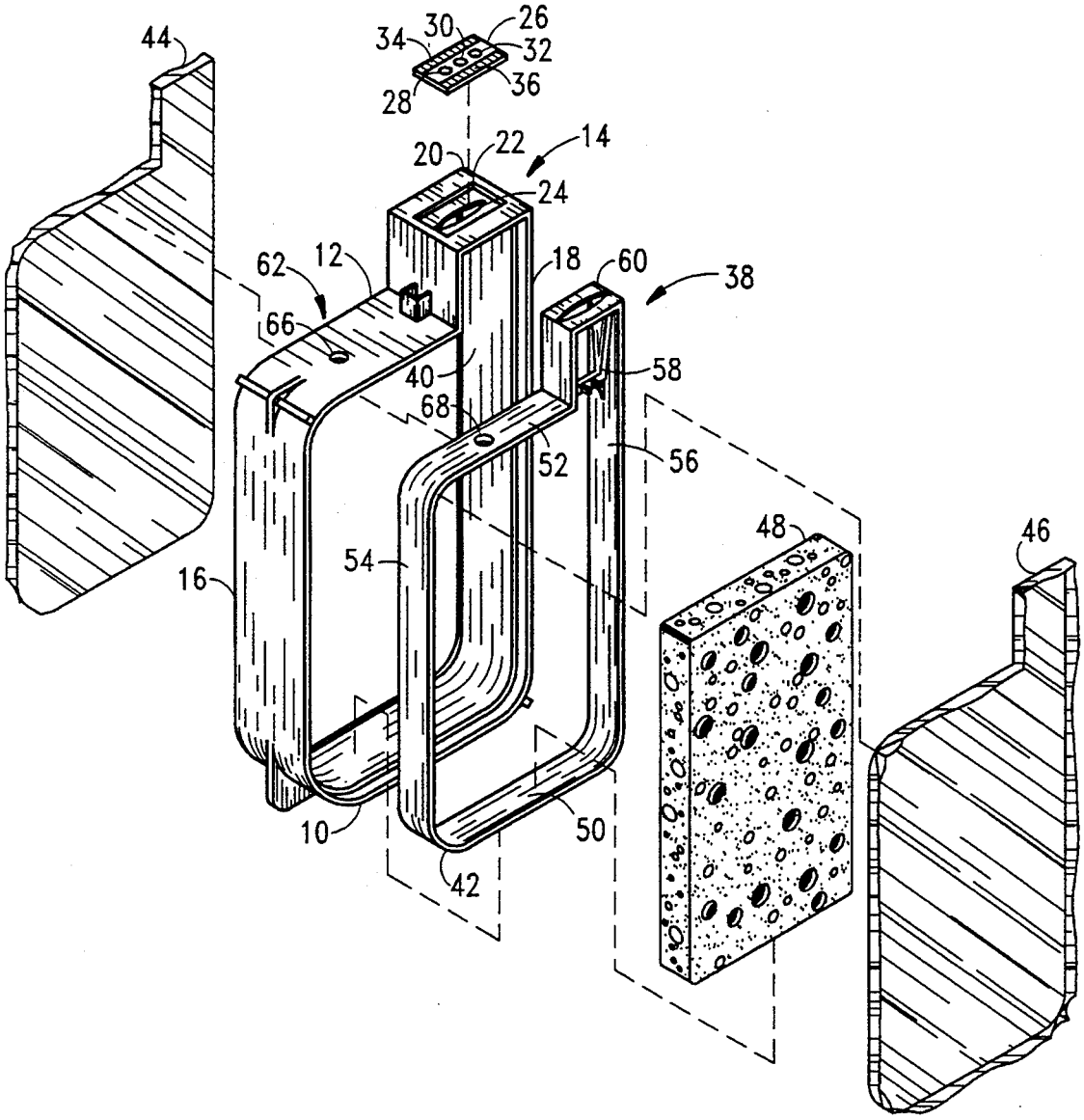
FIG. 1 is an exploded perspective view showing all of the various components of the novel thermal ink jet pen (TIJ) disclosed and claimed herein.

Referring now to FIG. 1, there is shown an exploded perspective view of the thermal ink jet pen body construction in accordance with the present invention. Both FIG. 1 and FIG. 2 described below are shown in the drawings in an upside down position in order to provide more constructional detail of this pen, particularly in the ink delivery section and thin film printhead components of the pen. Thus, the top and bottom walls 10 and 12 of the main unitary housing or frame member generally designated as 14 are actually the bottom and top walls, respectively, as viewed in FIGS. 1 and 2.

The main unitary frame member 14 further includes a pair of vertical side walls 16 and 18, with all of the top, bottom, and side walls 10, 12, 16, and 18 being molded of one piece construction in the geometry shown. The thermal ink jet pen body frame member 14 further includes an ink delivery and printhead support section 20 having a rectangular receptacle 22 therein including a centralized opening 24 for receiving a thin film printhead 26 of well known construction. The thin film printhead 26 will typically include a plurality of output ink injection orifice arrays 28, 30, and 32 which are arranged in the circular geometry shown in FIG. 1. The thin film printhead 26 further includes a plurality of electrical connection tabs 34 and 36 on each side thereof, and the thin film printhead may be generally of the type described, for example, in the above identified Baker et al U.S. Pat. No. 4,931,811. Also, for a further discussion of the details of both thin film printhead materials-set construction and electrical connections thereto, reference may be made to U.S. Pat. No. 4,812,859, issued to C. S. Chan et al, assigned to the present assignee and also incorporated herein by reference.

Referring again to FIG. 1, a structurally reinforcing interior frame or rib member 38 of matching but slightly smaller geometry and configuration is adapted for mounting on the interior mating walls 40 of the larger unitary pen body housing and frame member 14. This interior frame member 38 provides structural reinforcement of the complete pen body housing and further provides a thickness dimension 42 to which the thin, flexible plastic exterior walls 44 and 46 may be heat staked. This heat staking process is carried out after the rectangular block of foam 48 has been inserted in place within the region confined by the top and bottom walls 50 and 52 of the interior reinforcing frame member 38, the side walls 54 and 56 thereof and also by a small interior rib member 58 within the ink delivery section 60 of the interior frame member 38. Thus, the exterior geometry of the ink delivery section 60 matches the interior geometry of the ink delivery section 20 of the main unitary housing and frame member 14 of the pen.

Once the rectangular block of foam 48 has been inserted in place within the confines of the interior reinforcement frame member 38, the thin, flexible plastic walls 44 and 46 are brought into contact with the mating thickness dimension 42 of the internal frame member 38. Then the assembled pen is transferred to a heat staking station where the plastic flexible side walls 44 and 46 are fused into completely sealed contact with the thickness dimension 42 using known and controllable elevated temperatures and pressures well known to those skilled in the art of plastics and heat staking processes.

After the plastic side walls 44 and 46 are heat staked in place to completely seal off the block of foam 48 from the surrounding environment, the thin film TIJ printhead 26 is thermo-compression bonded into the mating rectangular receptacle 22 in the ink delivery section 20 of the pen. During a printing operation, ink will be drawn through the oblong opening 24 in the center of the receptacle 22 and then through ink passageways (not shown) internal to the printhead 26 and out of the orifices 28, 30, and 32. This ink ejection operation is accomplished by electrically pulsing heater resistors (also not shown) which are internal to the TIJ printhead 26, and these electrical pulses are applied through the various contact pads 34 and 36 and are more particularly described, for example, in the above identified U.S. Pat. No. 4,812,859 issued to C. S. Chan et al. However, when the TIJ pen is not printing, there is no air-ink interface within the pen, and the capillary properties of the block of foam 48 need not be used as a backpressure means to keep the pen from drooling ink.

Figure 2:
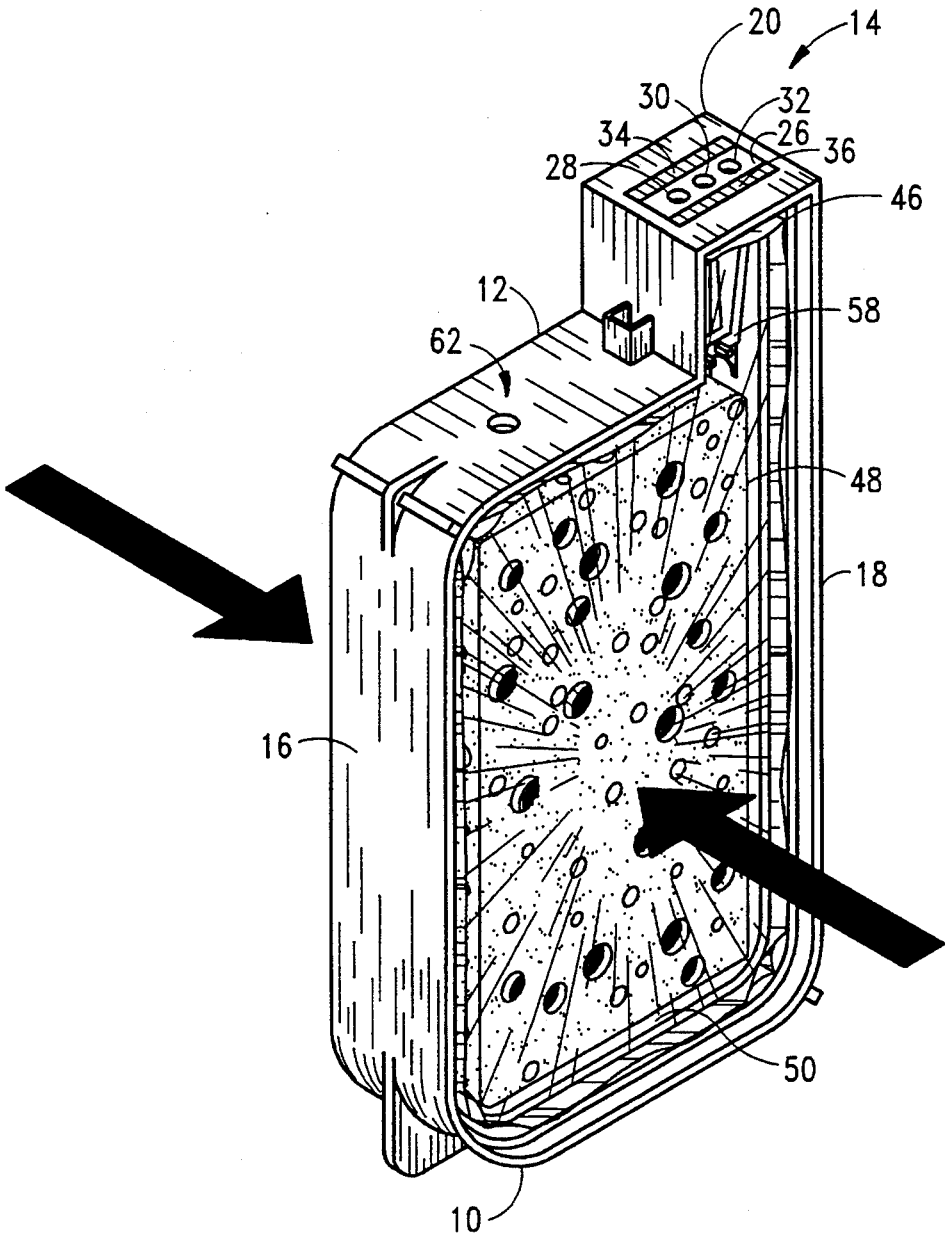
FIG. 2 is a completely assembled perspective view of the thermal ink jet pen constructed in accordance with the present invention.

Referring now to both FIGS. 1 and 2, with FIG. 2 showing the completely assembled pen in perspective view, an ink fill spout 62 is provided through both the opening 66 in the outer unitary frame and housing member 14 and a mating opening 68 in the interior reinforcing frame member 38. The spout 62 is adapted to receive an insertion tube from a source of ink supply (not shown) when the pen is to be filled. After ink filling, the pen is primed preferably through the orifice arrays 28, 30, and 32 which are shown in FIG. 2 and then completely sealed off in order to prevent the pen from depriming during shipment to the customer. When the thermal ink jet pen in FIG. 2 is repositioned in a preferably vertical orientation and then inserted into the pen carriage of a thermal ink jet printer and electrically connected to the pen driving circuitry through the plurality of contacts 34 and 36 on each side of the thin film printhead 26, this operation will pull ink through the output orifice arrays 28, 30, and 32 in a well known manner and thereby pull a negative backpressure within the pen body housing in FIG. 2.

This negative backpressure in turn produces the collapsing forces indicated by the arrows in FIG. 2 to start collapsing the plastic flexible side walls 44 and 46 into depressing contact with the abutting opposite walls of the block of foam material 48. As ink continues to be drawn out of the TIJ pen shown in FIG. 2, the negative backpressure therein will continue to increase and the block of foam 48 will continue to be depressed until its thickness has been reduced to the order of about 20% of its original size. At this point, an equilibrium condition is reached between the force of the collapsing thin film walls 44 and 46 and an equal and opposite repelling inherent spring force of the block of foam 48. Therefore, this single block of foam 48 operationally takes the place of the metal spring and piston plates described in the above identified applications Ser. Nos. 07/928,811 and 07/929,615, thereby facilitating the ease of pen body manufacture while simultaneously reducing its costs and complexity.

In contrast to the capillary action in the polyurethane foam used in some of the earlier developed Hewlett Packard thermal ink jet pens, capillary forces within the block of foam 48 are non-existent since there is no air/-liquid interface in this pen. Additionally, in contrast the operation of the above identified Hewlett Packard thermal ink jet pens, the block of foam 48 is not depleted of ink during the compression thereof to its point of maximum compression, and the block of foam 48 will always be completely filled with ink as it is compressed down to about 20% of its original thickness.

Thus, there has been described an elegantly simple pen body construction and method of manufacture and operation. This pen body construction is characterized by the use of components and a process of fabrication which are straightforward in assembly and economical in overall manufacture.

Various modifications may be made in and to the above described preferred embodiment without departing from the spirit and scope of this invention. For example, the present invention is not limited to the particular plastic thin film materials used in constructing the outer collapsible side walls 44 and 46. In addition, the foam required for constructing the rectangular block 48 does not need to have a specific type of cell or pore size and therefore could be an inexpensive foam readily available in the art, provided that it has suitable spring characteristics for creating the required backpressure in the ink reservoir. Furthermore, the various frame pieces described above do not have to be insert molded, thereby simplifying the molding process for these frame pieces and reducing manufacturing costs. Accordingly, the above modifications and other variations in constructional design of the thermal ink jet pen are within the scope of the following appended claims.

I claim:

1. A method of operation of an ink jet pen having a resilient foam material having an inherent spring force located in an ink storage compartment having side walls, said foam material being fluidically coupled to a thin film ink jet printhead, the improvement comprising the steps of sealing off said ink storage compartment from surrounding ambient atmosphere and then collapsing said side walls of said ink storage compartment to create a negative backpressure therein until an equilibrium condition is reached in said compartment where a collapsing force of said side walls is equal and opposite to said inherent spring force of said foam material and wherein the step of collapsing said side walls includes drawing ink and air out of said compartment to create said negative backpressure therein until said collapsing force of said side walls is equal and opposite to said inherent spring force of said resilient foam material, at which time the negative backpressure in said compartment is substantially stabilized.

2. A method of making an ink jet pen having a foam material within an ink storage compartment which is fluidically coupled to a thin film ink jet printhead, comprising the steps of:

a. providing said compartment with a pair of thin flexible side walls, b. inserting the foam material inside said compartment and filling said foam material and compartment with ink said foam having opposed sides, c. sealing off said compartment from surrounding ambient atmosphere by heat staking said thin flexible side walls to a unitary frame housing member, said unitary frame member being formed by providing an outer housing frame member and securing therein a rib reinforcing frame member having a thickness dimension which provides surfaces on the opposed sides of said foam to which said flexible side walls may be heat staked at an elevated temperature and pressure, and d. priming said compartment for shipment after the ink filling thereof in order to prevent the pen from drooling ink prior to use in a thermal ink jet printer.

* * * * *